US005170519A

United States Patent [19]

Meade

[11] Patent Number: 5,170,519

[45] Date of Patent: Dec. 15, 1992

[54] CONVERTIBLE FURNITURE FRAMES

[76] Inventor: Thomas L. Meade, 274 Reese Rd., Nittany Mountain Industrial Park, State College, Pa. 16801

[21] Appl. No.: 812,516

[22] Filed: Dec. 20, 1991

[51] Int. Cl.[5] ..... A47C 17/16

[52] U.S. Cl. ..... 5/37.1; 5/12.1; 5/57.2

[58] Field of Search ..... 5/12, 17, 37.1, 42.1, 5/47, 48, 52, 57.2

[56] References Cited

U.S. PATENT DOCUMENTS

| | | | |
|---|---|---|---|
| 910,952 | 1/1909 | Phillipson | 5/42.1 |
| 2,294,475 | 9/1942 | McAllister . | |
| 3,867,730 | 2/1975 | Wright | 5/42.1 |
| 4,168,860 | 9/1979 | Garza et al. | 5/47 X |
| 4,538,308 | 9/1985 | Grigoriev | 5/37.1 |
| 4,601,074 | 7/1986 | Welsch et al. | 5/42.1 X |
| 4,616,370 | 10/1980 | Keenan et al. | 5/12.1 X |
| 4,642,823 | 2/1987 | Wiggins | 5/47 |
| 4,692,952 | 9/1987 | Dougher et al. | 5/37.1 |
| 4,829,611 | 5/1989 | Fireman et al. | 5/47 |
| 4,875,244 | 10/1989 | Tremblay | 5/37.1 |

FOREIGN PATENT DOCUMENTS

| | | | |
|---|---|---|---|
| 787422 | 12/1957 | United Kingdom | 5/37.1 |
| 943620 | 12/1963 | United Kingdom | 5/37.1 |

*Primary Examiner*—Michael F. Trettel

*Attorney, Agent, or Firm*—Caesar, Rivise, Bernstein, Cohen & Pokotilow, Ltd.

[57] ABSTRACT

A convertible furniture frame construction which is movable from a first orientation to at least a second orientation. The frame includes at least two sections pivotally connected together and being movable relative to each other to permit the frame to be moved between the first and second orientations. One of the two sections includes a frame member having one end closely adjacent to, and overlapping an end of a frame member of the other of the two sections. A unique hinge and stop arrangement is provided for permitting relative rotational movement between the two sections to permit conversion of the frame between the first and second orientations, and also for locking the two sections against relative rotational movement in one of the first and second orientations. The hinge and stop arrangement includes an elongate slot in one of the overlapping ends and a hinge pin connected to the other of the overlapping ends. The hinge pin is rotatably retained within the slot to provide a pivotal connection between the first and second sections. Cooperating stop members are provided on the adjacent overlapping ends for engaging each other when the hinge pin is in a first location within the elongate slot to maintain the frame in the first orientation, and for disengaging from each other when the hinge pin is in a second position within the elongate slot to permit the frame to assume the second orientation.

23 Claims, 4 Drawing Sheets

FIG. 8
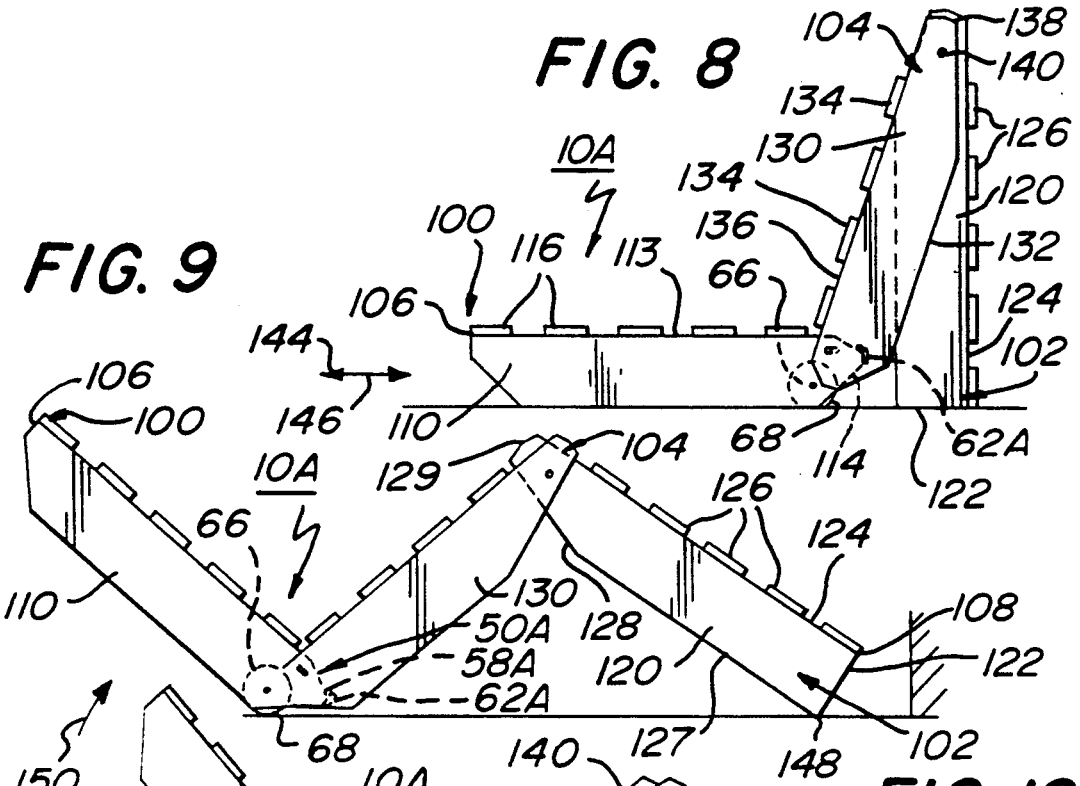
FIG. 9
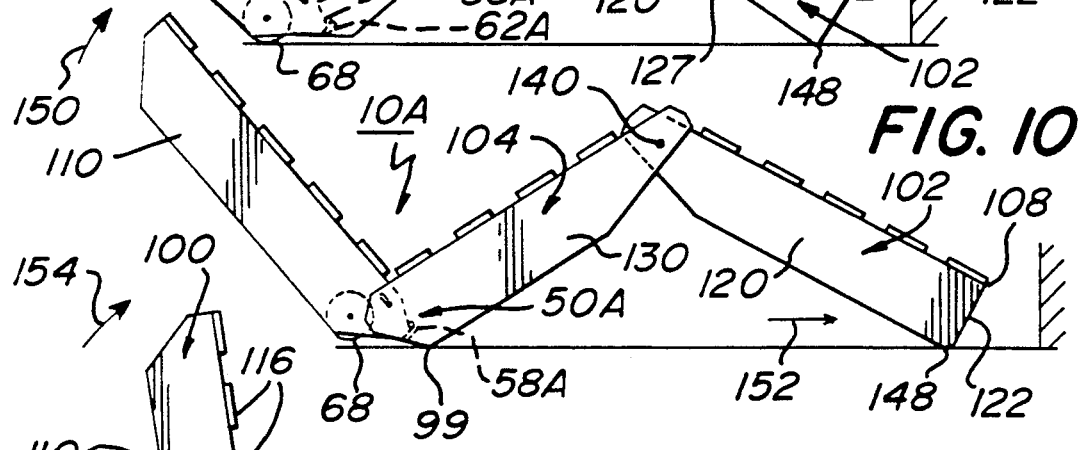
FIG. 10
FIG. 11
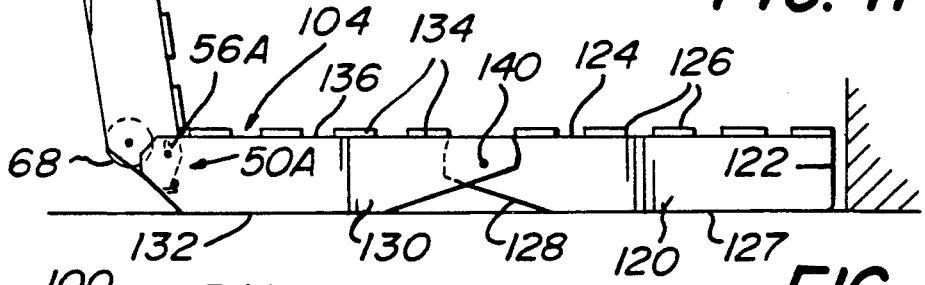
FIG. 12
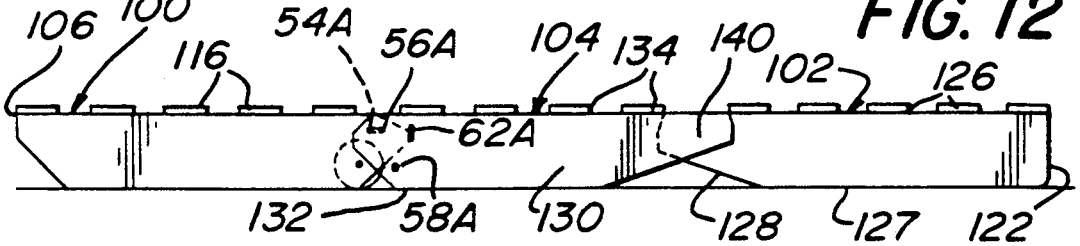

CONVERTIBLE FURNITURE FRAMES

FIELD OF THE INVENTION

This invention relates generally to convertible furniture frames, and more specifically to convertible frames of the bi-fold and tri-fold type, which are ideally suited for use in supporting futons in different body-supporting orientations.

BACKGROUND ART

Both bi-fold and tri-fold frames for supporting futons are well known in the prior art. The bi-fold frames include two sections which generally are movable relative to each other, between a "couch" orientation, in which the sections are disposed to form a seat and backrest, and a "bed" orientation, wherein futon-supporting surfaces of the two sections generally lie in the same plane. In this latter orientation the futon functions as a mattress, with the distance between the front edge of the seat section and the rear edge of the backrest section constituting the width of the bed, and with the length of the frame, from one side edge to the other side edge, constituting the length of the bed.

In order to maintain the sections of the bi-fold units in the required orientation to provide a seat and backrest for supporting a futon, it is necessary to provide a locking arrangement between the pivotal sections. Although some of the prior art locking arrangements have been fairly simple in construction, they have been very difficult to operate.

In one prior art construction pivoting locking blocks are rotatably secured to transversely-spaced side frame members of the backrest section. These blocks are designed to engage the upper surface of the section forming the seat, to prevent inadvertent movement of the backrest section relative to the seat section when the frame is being employed in its "couch" orientation. Although this pivoting block arrangement may provide a satisfactory locking force to maintain the bi-fold sections in the "couch" orientation, it is quite cumbersome to operate the blocks for the purpose of converting the frame to its "bed" orientation, and then back to its couch orientation. Specifically, in order to make these conversions it is necessary for the person to physically bend over and rotate the block on each side frame of the backrest section. This generally requires the user to move from one side of the frame to the other, and in some cases, may even require two individuals to simultaneously move the pair of pivoting blocks. Moreover, since the pivoting blocks generally are adjacent the lower end of the backrest section (in order to properly engage the seat section) the person operating the frame often needs to bend into an uncomfortable position to operate the pivoting blocks.

In another arrangement wooden dowel pins are provided to fit into aligned holes of the seat section and backrest section, at each side of the construction, when the seat and backrest sections are disposed in the "couch" orientation. In other words, it is in this orientation that the openings are aligned to receive the dowel pins. In order to convert this latter frame construction into a bed it is necessary for a person to first remove the dowel pin from one side of the construction, and then from the other side. Moreover, it is quite inconvenient and cumbersome to again try to reposition and lock the frame members in the "couch" orientation.

In view of the problems associated with prior art bi-fold constructions, a need exits for a economical and simple-to-operate bi-fold unit which can easily be converted between a "couch" and a "bed" frame orientation, without requiring a person to move from one side of the frame to the other.

Tri-fold frame constructions for futons also have been around for years, and actually have been the standard frame construction in the industry. Although a variety of different mechanisms are employed to permit these tri-fold constructions to be oriented into different positions, the operating mechanisms often are difficult to use, and in many cases can actually damage the floor or other supporting surface when being opened from a seating piece orientation to a bed frame orientation.

One of the major disadvantages of prior art tri-fold constructions is the difficulty of converting the frame from a bed to a couch. First, the futon (which functions as the mattress of the bed) must be folded in half to expose the back or rear portion of the frame. Thereafter, the exposed frame section must be raised and locked, and then the entire frame, with the futon on it, must be slid back to the original position, usually against a wall. This is not an easy task, in view of the fact that the combined frame and futon weighs on the order of 100–140 pounds. Thus, what is intended to otherwise be a versatile piece of furniture, in actuality is difficult to use, and therefore unappealing. In fact, these prior art constructions may be impossible to operate by many individuals, such as individuals of small stature, individuals having little strength, or individuals that are elderly and/or handicapped.

Another disadvantage of some prior art tri-fold constructions, becomes apparent when converting the frame from a "couch" or "chair" position, to a bed configuration. In order to accomplish this conversion the seat section generally is pulled out first, to thereby cause all three sections to pivot relative to each other. However, at some point the combined weight of the frame and futon overcomes the frictional resistance to sliding movement of the back section, resulting in both the middle and back sections collapsing to the floor. This often provides a very loud and disturbing noise, particularly in situations where the floor is not carpeted, which is often the case in studio apartments, dormitories and temporary housing in which the use of futon frames is becoming quite popular.

Other prior art convertible furniture constructions are shown in U.S. Pat. Nos. 4,875,244; 4,829,611; 4,692,952; 4,642,823; 4,538,308 and 2,294,475. However, none of the prior art constructions known to applicant solve the heretofore mentioned problems associated with bi-fold and tri-fold frame constructions.

In view of the above deficiencies a need exists in the industry for a low cost, convenient-to-operate, tri-fold futon frame which is easily convertible between multiple positions, and which does not suffer from the above-enumerated disadvantages of the prior art.

OBJECTS OF THE INVENTION

It is a general object of this invention to provide convertible furniture frames which are simple in construction, easy to use and reliable in operation.

It is a further object of this invention to provide convertible furniture frames which have an uncomplicated mechanism for retaining the frames in the form of a seating piece (e.g., a chair, couch or similar construction), while permitting the easy and reliable release of the mechanism to permit the frames to assume a different orientation, such as the orientation of a bed frame.

It is a further object of this invention to provide convertible furniture frame constructions which are well suited for use in supporting futons in different orientations, and which can be moved between these different orientations from a single location relative to the frame.

It is a more specific object of this invention to provide convertible furniture frames which are ideally suited for use in supporting futons in multiple orientations, and wherein the frames can easily and reliably be converted between different orientations from the front of one of the frame sections.

It is still a further object of this invention to provide a convertible, bi-fold frame construction for supporting a futon in different orientations, which is simple in construction, reliable in operation and easy to use.

It is still a further object of this invention to provide a convertible tri-fold frame construction for supporting a futon in multiple orientations, and which is simple in construction, reliable in operation and easy to use.

SUMMARY OF THE INVENTION

The above and other objects of this invention are achieved in a convertible furniture frame construction which is movable from a first orientation to at least a second orientation. The frame includes at least two sections pivotally connected together and being movable relative to each other to permit the frame to be moved between the first and second orientations. One of the two sections includes a frame member having one end closely adjacent to, and overlapping an end of a frame member of the other of the two sections. A unique hinge and stop arrangement is provided for permitting relative rotational movement between the two sections to permit conversion of the frame between the first and second orientations, and also for locking the two sections against relative rotational movement in one of the first and second orientations. The hinge and stop arrangement includes an elongate slot in one of the overlapping ends and a hinge pin connected to the other of the overlapping ends. The hinge pin is rotatably retained within the slot to provide a pivotal connection between the first and second sections. Cooperating stop members are provided on the adjacent overlapping ends for engaging each other when the hinge pin is in a first location within the elongate slot to maintain the frame in the first orientation, and for disengaging from each other when the hinge pin is in a second position within the elongate slot to permit the frame to assume the second orientation.

In a preferred embodiment of the invention the cooperating stop members include a stop plate on one of the overlapping ends and a stop pin on the other of the overlapping ends. The stop pin and stop plate are located to engage each other when the hinge pin is in a first location within the elongate slot to maintain the frame in the first orientation, and to be disengaged from each other when the hinge pin is in a second location within the elongate slot to permit the frame to assume its second orientation.

In the most preferred embodiment of this invention two sections of the convertible furniture frame provide a seat section and backrest section in a first orientation, and provide a bed frame in a second orientation.

In one preferred embodiment of the invention the convertible furniture frame includes two sections pivotally interconnected to each other, and in an alternative embodiment of the invention the convertible furniture frame includes three sections rotatable connected relative to each other.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein.

FIG. 8 shows, on a reduced scale, a convertible furniture frame in accordance with a second embodiment of the invention, showing its orientation as a seating piece;

FIGS. 9–12 illustrate sequential stages in converting the furniture frame of FIG. 8 into the orientation of a bed frame, as shown in FIG. 12.

DESCRIPTION OF THE PREFERRED EMBODIMENTS OF THE INVENTION

Figure 1:
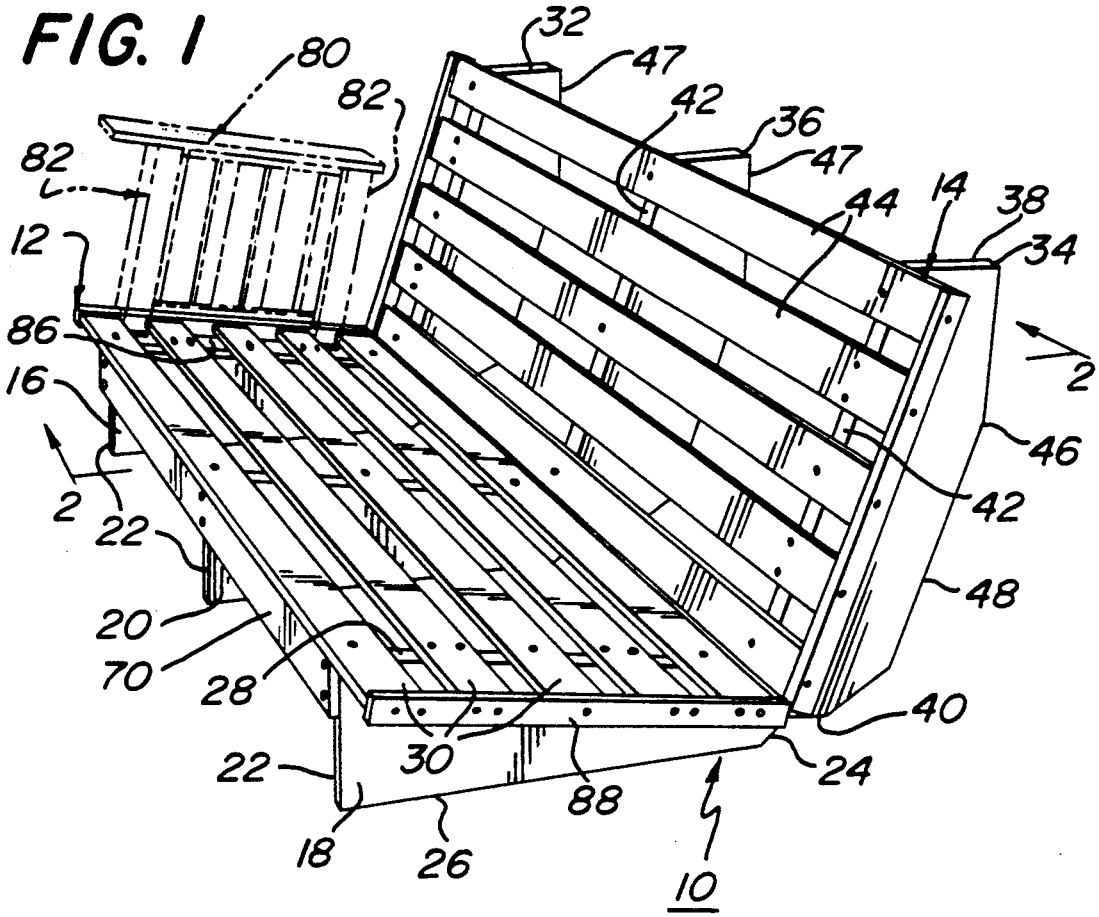
FIG. 1 is an isometric view of a convertible furniture frame in accordance with one embodiment of this invention, with an optional, removable arm rest being shown in phantom.
Figure 2:
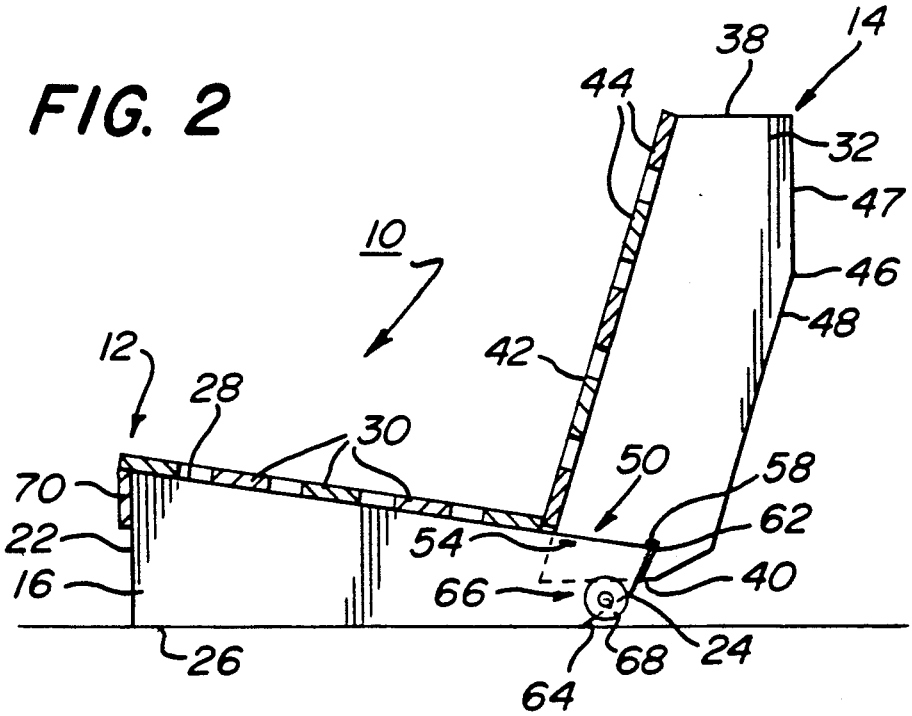
FIG. 2 is a sectional view taken along 2—2 of FIG. 1.

Referring now in greater detail to the various figures of the drawings wherein like reference characters refer to like parts, a convertible furniture frame embodying the present invention is generally shown at 10 in FIG. 1. FIG. 1 basically is in the form of a bi-fold futon frame including two sections 12 and 14, rotatably interconnected by a unique hinge and stop arrangement 50 to be described in detail later in this application. As can be seen in FIGS. 1 and 2, this hinge and stop arrangement 50 positively maintains the two sections 12 and 14 in the orientation of a seating piece, preferably to support a futon thereon.

Referring specifically to FIGS. 1 and 2, the section 12 includes identical transversely spaced-apart side frame member 16 and 18, and an intermediate frame member 20. Each of these frame members has a forward edge 22, a rear edge 24, a bottom edge 26 (which is supported on the ground or other supporting surface) and a top edge 28 to which a plurality of elongate slats 30 are secured. These slats 30 provide the supporting surface for the futon.

As can be seen best in FIG. 2, each of the frame members 16, 18 and 20 is tapered in a direction from the forward edge 22 to the rearward edge 24. In the preferred embodiment of this invention each of these frame members is formed from $1\frac{1}{4}''$–$1\frac{1}{2}''$ wide stock, and is tapered linearly at an angle of approximately $8\frac{1}{2}$ degrees from the horizontal.

The section 14 is similar in construction to section 12; however, the configuration of transversely spaced-apart side frame members 32 and 34, and intermediate frame member 36 is somewhat different. Specifically, with section 14 oriented at approximately a 17 degree angle to the right of the vertical axis, as viewed in FIG. 2, to provide a comfortable, sloping backrest section, the frame members 32, 34 and 36 each have an upper surface 38 which is oriented in a generally horizontal plane, a bottom surface 40, a front surface 42 to which elongate slats 44 are secured by nails, screws or other suitable fastening means, and a rear surface 46. This rear surface 46 has an angled upper section 47 which, with section 14 oriented as illustrated in FIG. 2, is in a generally vertical plane. Because of this orientation the angled upper section 47 of each of the frame members 32, 34 and 36 tends to lie closely adjacent a vertical wall against which the frame 10 may be positioned. The rear surface 46 also includes a lower section 48 which is inclined at an angle with respect to upper section 47, and is designed to lie in a generally horizontal plane to engage the floor or other supporting surface, when the frame 10 is oriented into a bed frame, as is illustrated in FIG. 7.

Figure 5:
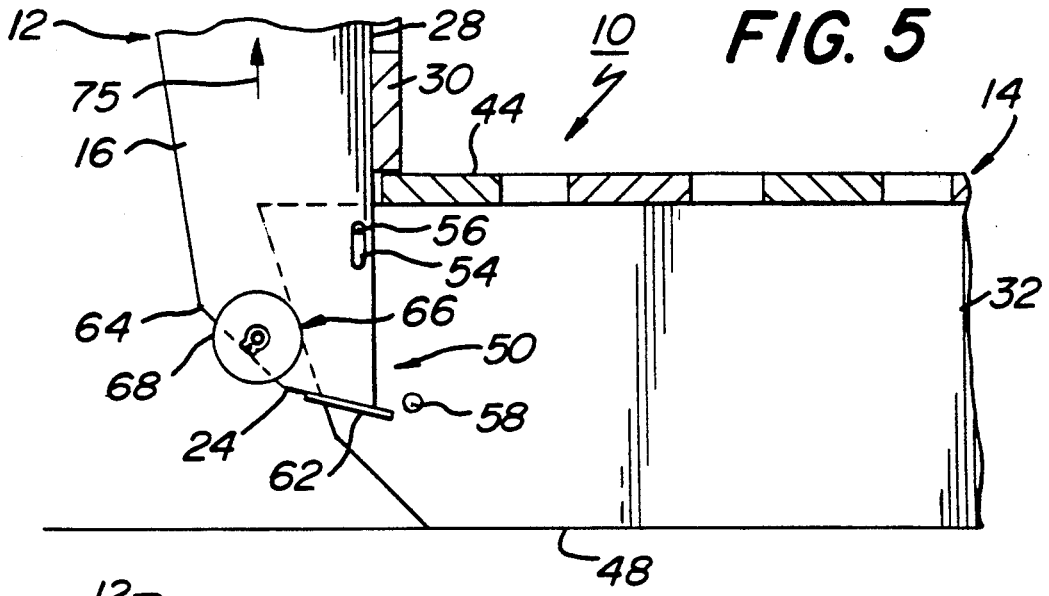
Figure 6:
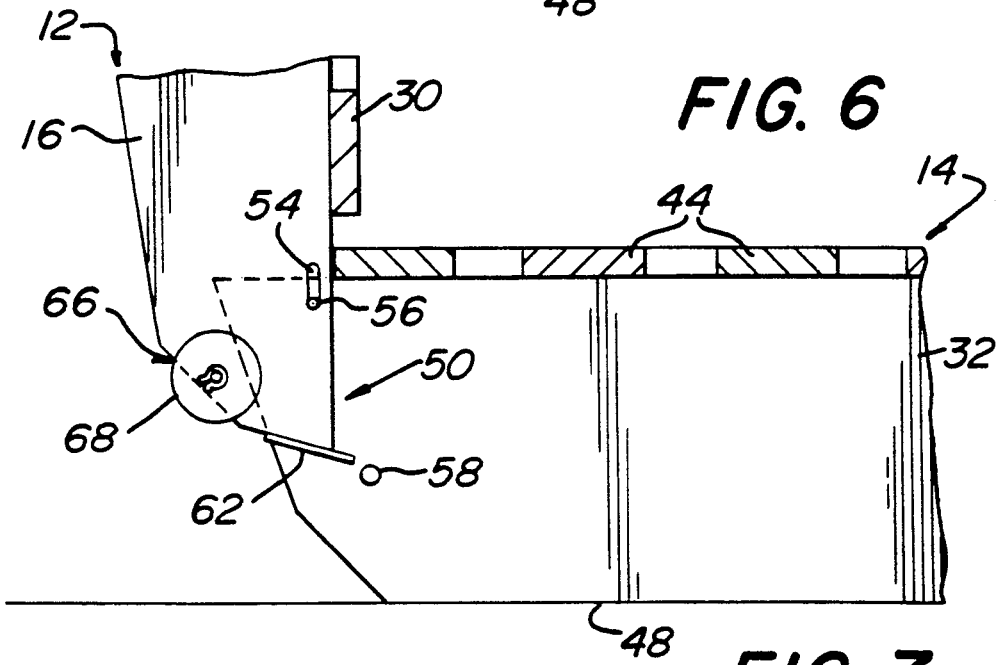
Figure 7:
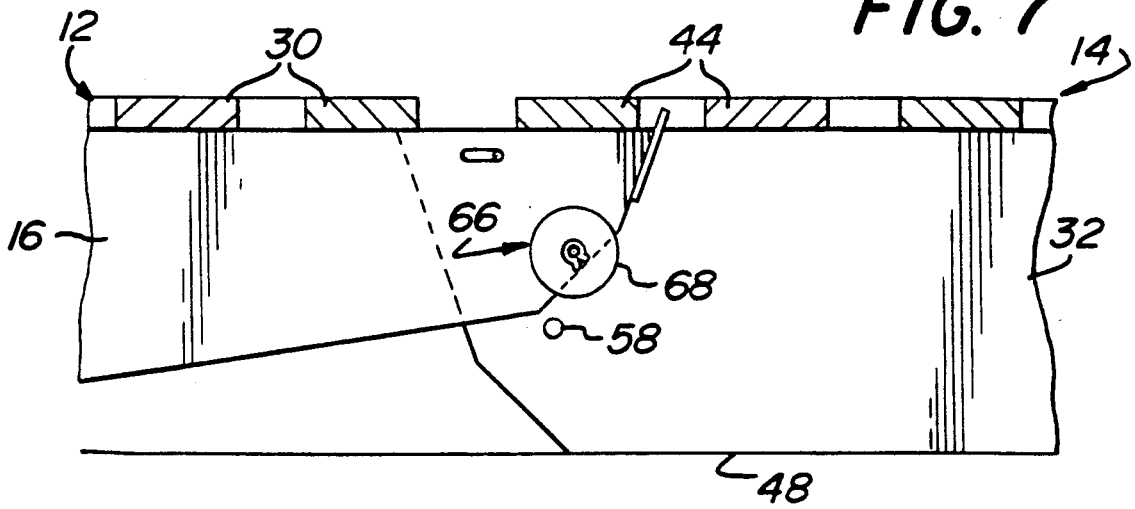

Referring specifically to FIGS. 2–7, a unique hinge and stop arrangement 50 is provided to positively maintain or lock the sections 12 or 14 at approximately a 98½ degree angle relative to each other (with the angle being tilted approximately 8½ degrees clockwise from the horizontal plane, as viewed in FIG. 2) to form a seating piece frame (e.g., loveseat, couch or chair) as is shown in FIG. 1, and which can easily be manipulated to permit relative movement between the sections 12 and 14 to form a bed frame, as is shown in FIG. 7.

Referring to FIGS. 2–7 the cooperative elements of the hinge and stop mechanism 50 associated with adjacent side frame members 16 and 32 of sections 12 and 14, respectively, will be described. It should be understood that this same hinge and stop mechanism is associated with the adjacent side frame members 18 and 34, and with the adjacent intermediate frame members 20 and 36.

Figure 3:
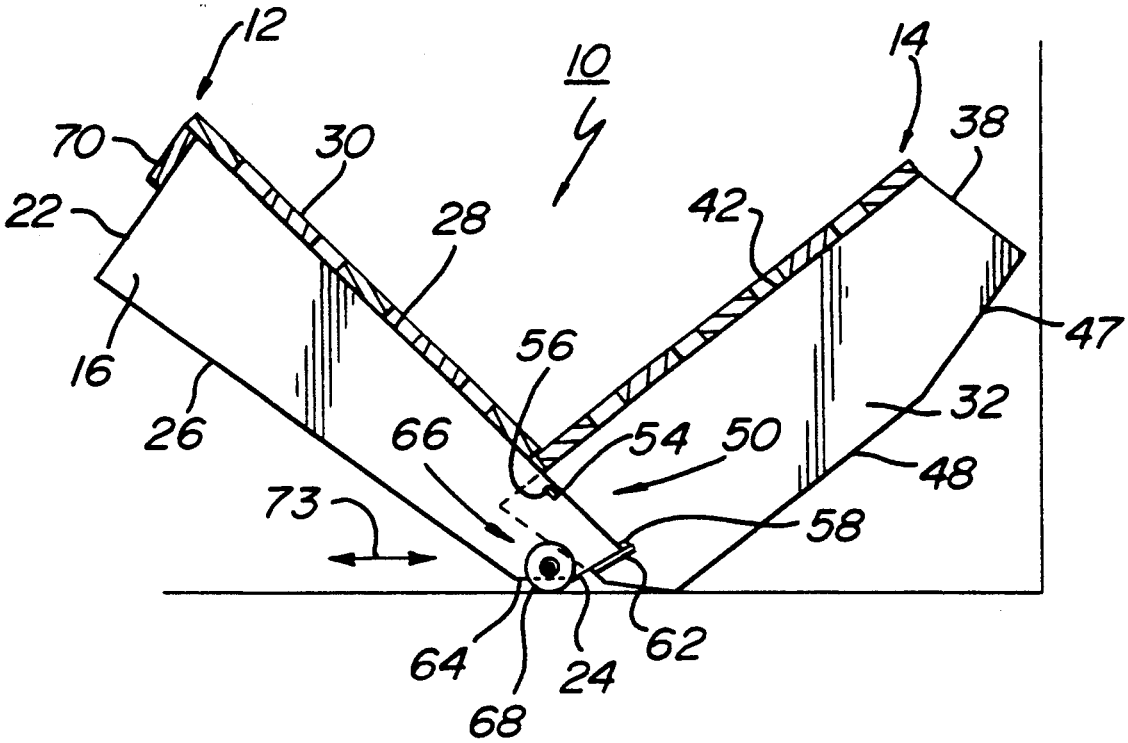
FIGS. 3–7, show sequential stages in changing the orientation of the frame sections from that shown in FIG. 2, to that shown in FIG. 7.

Referring specifically to FIGS. 3 and 5, the hinge and stop mechanism 50 includes an elongate slot 54 provided in side frame member 16 of section 12, and into which a hinge pin 56 extends. This hinge pin 56 is secured within an opening (not shown) in the side frame member 32 of section 14, and cooperates with the slot 54 to provide a hinge connection about which the sections 12 and 14 are rotatable relative to each other.

Still referring to FIG. 2, the slot 54 is elongated, having its long dimension aligned in a direction from forward edge 22 to the back edge 24 of side frame member 16, and being essentially parallel to the top surface 28 of said side frame member. When the sections 12 and 14 are maintained in the orientation of a seating piece, as is shown in FIGS. 1 and 2, the hinge pin 56 extends into the elongate slot 54 adjacent the left or forward end of the slot, as viewed in FIG. 2, and as can be seen best in FIGS. 3–5.

As will be explained in greater detail hereinafter the provision of an elongate slot 54 for cooperating with the hinge pin 56 is very important in this invention, and, in general, permits the desired locking of the sections 12 and 14 in the orientation illustrated in FIGS. 1 and 2, while at the same time permitting easy release of the locking arrangement, to permit the sections 12 and 14 to assume the configuration shown in FIGS. 7, in which the frame 10 functions as a bed frame for a futon or other mattress-type surface.

Referring to FIGS. 2–5, the locking arrangement provided by the hinge and stop mechanism 50, in the preferred embodiment, includes a stop pin 58 retained within an opening (not shown) in side frame member 32 of the section 14, and extending transversely therefrom into overlying relationship with an upper section of a metal stop plate 62. The metal stop plate 62 is secured to the rear edge 24 of frame member 16 by screws, adhesive, or other suitable fastening means. In addition to engaging the stop plate 62, the stop pin 58 also engages an angled section of the top surface 28 of the side frame 16. In fact, the stop pin is located so that its predominant force is imposed against the top surface 28 of the side frame 16, as opposed to being imposed upon the stop plate 62, when a force is applied to backrest 14, such as when an individual is seated on a futon supported over the frame.

In the most preferred embodiment of this invention the frame members 32, 34 and 36 are made of a hard wood, so as to minimize the likelihood of wear in the region of the openings in which the stop pins 58 are secured. In addition, in the preferred embodiment of this invention the stop pin 58 extends transversely from the frame members 32, 34 and 36 in a slightly downwardly inclined orientation, to compensate for wear which tends to take place in the side frame members 32, 34 and 36, in the region in which the stop pin 58 is secured. Specifically, as the region adjacent each opening receiving a stop pin 58 wears, the pin 58 will tend to move in an upward direction (as viewed in FIG. 2), thereby assuming a generally horizontal orientation, in view of the fact that it initially was secured to the frame member 32 in a slightly downwardly inclined orientation (e.g., on the order 2–3 degrees). This arrangement insures that secure contact between the pin 58 and the upper section of stop plate 62 is continuously maintained over the expected life of the product.

It should be understood that the cooperative arrangement between the elongate slot 54 and the hinge pin 56, as well as the cooperative arrangement between the stop pin 58 and stop plate 62, as described above, also are provided between the adjacent sections of side frame member 18 of section 12 and side frame member 34 of section 14, and also between the adjacent sections of intermediate frame member 20 of section 12 and intermediate frame member 36 of section 14. Since the construction of the hinge and stop mechanism 50 is identical at all of these latter locations, no further description is necessary to provide a teaching that is understandable to a person skilled in the art.

Referring to FIGS. 2–5, the back edge 24 of the side frame 16 has a tapered, or inclined, lower edge section 64, and a wheel or roller 66 is rotatably secured to the frame member 16 adjacent this latter edge. The wheel 66 is mounted so that a portion of the peripheral surface 68 of the wheel is located beyond the edge 64, and therefore capable of rotatably engaging the floor or other frame-supporting surface, as the frame is being converted from its orientation as a seating piece (e.g., FIGS. 1 and 2) into its orientation as a bed (FIG. 7).

It should be understood that the back edge 24 of the other side frame member 18 and of the intermediate frame member 20 are likewise provided with a inclined edge surface identical to edge surface 64, and that a rotatable roller or wheel, identical to wheel 66, is secured to the other side frame member 18 in exactly the same location as the wheel 66 is secured to the side frame member 16. In the most preferred embodiment of this invention the intermediate frame section 20 does not include a wheel, since it actually is not necessary to provide for ease of convertibility of the furniture frame 10 between different orientations.

Referring to FIGS. 3–7, the manner in which the convertible furniture frame 10 is converted from a seating piece orientation, as is shown in FIGS. and 2, to a bed frame orientation as is shown in FIG. 7, will now be described.

First, and foremost, it should understood that the entire conversion operation can be carried out by a person standing adjacent the front edge of section 12. In other words, there is no need for the individual to manually engage any locking mechanisms adjacent the opposed side frames of the frame construction, in order to release the locking engagement between the sections 12 and 14 required to convert the frame between seating piece and bed orientations.

To convert the frame from a seating piece to a bed an individual stands adjacent the front of the seating piece (i.e., adjacent the front of the section 12) and lifts or rotates the seating piece in an upward direction, to approximately 45 degrees from the horizontal, as is shown in FIG. 3. The user can easily grip the section 12 by engaging transversely extending slat or skirt 70, which is secured by nails or other suitable fastening means to the forward edge 22 of each of the frame sections 16, 18 and 20 (see FIGS. 1 and 2).

As can be seen in FIG. 3, after the seat section 12 initially has been lifted or rotated the periphery 68 of the wheel or roller 66 immediately comes into contact with the frame-supporting surface (e.g., the floor). However, it should be clearly understood that in this orientation the sections 12 and 14 are retained in a locked condition to prevent the opening or separation of the sections 12 and 14 relative to each other.

With the wheel 66 engaging the supporting surface, the frame 10 can easily be rolled to any desired location, as is schematically indicated by the double-headed arrow 73 in FIG. 3. Once the frame 10 is in its desired located the seat section 12 can be further rotated upwardly, or clockwise as viewed in FIG. 3, into the orientation shown in FIG. 4. Specifically, in this latter orientation the backrest section 14 is positioned in a generally horizontal plane, with the lower section 48 of the bottom edge surface 46 in engagement with the frame supporting surface. In this orientation the outer surface of section 12 is disposed approximately 8½ degrees to the left of vertical, as viewed in FIG. 4, and the stop pin 58 is still in engaged, overlying relationship with the upper section of the stop plate 62. Thus, it should be apparent that the movement of the section 14 into the horizontal position illustrated in FIG. 4 is positively controlled by maintaining the locked connection between sections 12 and 14, as the section 12 is being gripped and rotated in a clockwise direction, as viewed in FIG. 4.

Figure 4:
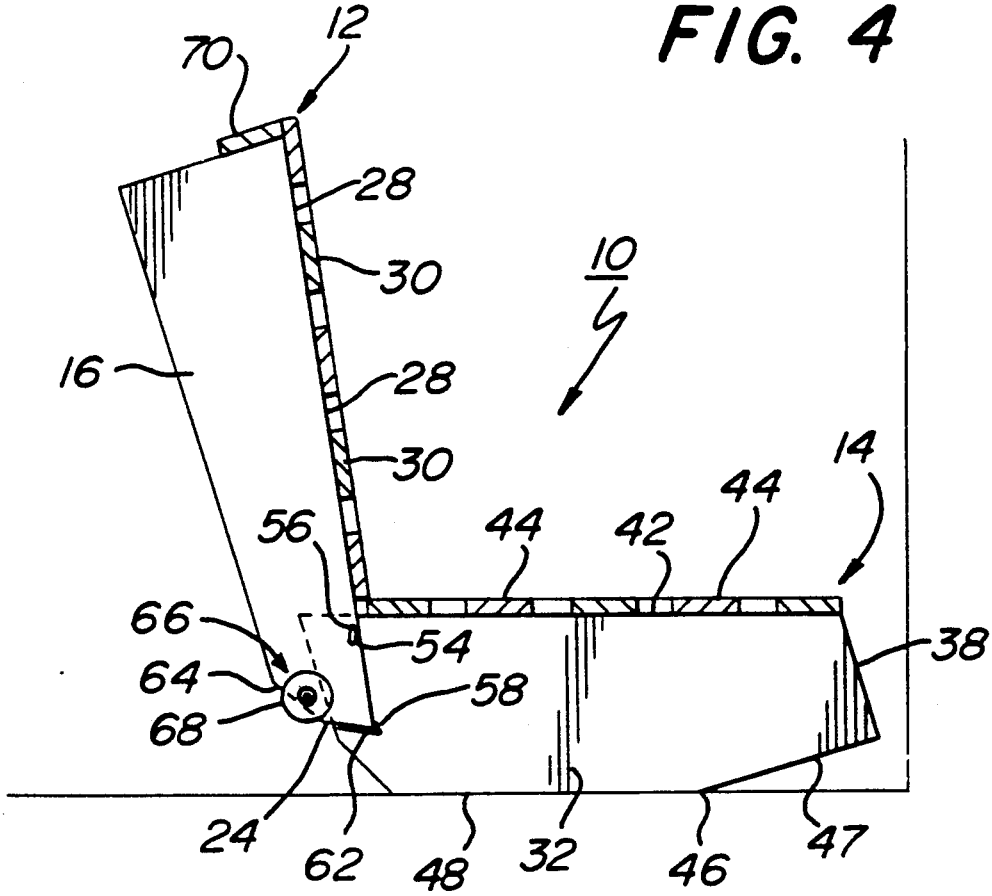

Referring to FIG. 5, after the frame 10 has been moved into the orientation shown in FIG. 4 the section 12 is rotated in a clockwise direction (as viewed in FIG. 5) into a position wherein the upper supporting surfaces provided by the elongate slats 30 and 44 are disposed at approximately 90 degrees to each other, as is shown in FIG. 5. In other words, the outer surface provided by the slats of section 12 is oriented in a generally vertical direction, and, in this orientation, the upper section of the stop plate 62 is moved out of underlying position with the stop pin 58. In this latter orientation it is possible to move the section 12 in a generally upward direction, as is illustrated by arrow 75, to thereby move the stop plate 62 into a position above the stop pin 58, as is shown in FIG. 6. It should be noted that, in this latter position, the hinge pin 56 is located at the opposite end of the slot 54 from the end it occupies when the upper section of the stop plate 62 is in underlying, locking engagement with the stop pin 58.

Still referring to FIG. 6, after the stop plate 62 has been moved out of underlying relationship with the stop pin 58, and the section 12 lifted to cause the stop plate to clear, or move about the stop pin, the section 12 is then rotated in a counterclockwise direction, as viewed in FIG. 6, to thereby pivot the section 12 into an orientation in which the upper surface thereof is disposed in a generally horizontal plane, as is shown in FIG. 7. In fact, the upper surfaces of sections 12 and 14 are located essentially in the same plane to thereby form a bed frame.

As was pointed out earlier herein, in a bi-fold construction the length of the seating piece from one side to the other actually constitutes the length of the bed frame, in the open configuration illustrated in FIG. 7. In other words, when the frame 10 is opened into a bed frame, a person generally sleeps on the frame with his or her head adjacent one side edge and his or her feet adjacent the opposite side edge. The width of the bed, which generally is a full or queen size bed, is the distance between the forward edge of the section 12 and the top edge of the section 14, when the sections are disposed in the orientation illustrated in FIG. 7.

Referring to FIG. 1, one or more removable arms 80 can be employed with the frame 10, when the frame 10 is in a seating piece orientation as shown in FIGS. 1 and 2. Since the provision of an armrest is optional, it is illustrated in phantom in FIG. 1. Suffice it to state that the armrest can be removably attached to section 12 in a variety of ways. In one preferred embodiment the armrest includes a pair of outer posts 82, each having a generally U-shaped slot at the base thereof for frictionally (and removably) engaging side frame members 86 and 88 of section 12.

Referring to FIGS. 8–12 a second preferred embodiment of a convertible furniture frame is shown at 10A.

Referring specifically to FIG. 8, the convertible furniture frame 10A is a tri-fold unit including a forward section 100, a rearward section 102, and an intermediate section 104 hinged for pivotal movement to both the forward and rearward section, in a manner which will be described in detail hereinafter. As illustrated in the drawings the tri-fold frame 10A is movable from a first orientation, in the form of a seating piece (e.g., couch, loveseat and/or chair), as in FIG. 8, to a fully opened bed configuration, as in FIG. 12.

The bed formed from the tri-fold frame 10A has a length extending from a forward edge 106 of forward section 100 to a rear or bottom edge 108 of rearward section 102, and with the transverse or width dimension of the bed being defined by the transverse distance between side margins of the forward, rearward and intermediate sections. Thus, it should be apparent that the transverse dimension of the tri-fold frame 10A generally is smaller than the transverse dimension of the bi-fold frame, by virtue of the fact that in the tri-fold frame the transverse dimension defines the width of the bed, whereas in the bi-fold frame the transverse dimension defines the length of the bed. Because of this reduced width the tri-fold frame 10A may not require an intermediate frame member to aid in supporting or mounting transversely extending slats, similar or equivalent to the intermediate frame member 20 of the bi-fold unit illustrated in FIG. 1.

The construction of the forward section 100, rearward section 102 and intermediate section 104 is similar to the construction of sections 12 and 14 of the bi-fold frame 10, but does differ from the bi-fold sections in certain respects, which will be described hereinafter.

Referring to FIG. 8, forward section 100 includes a pair of identical side frame members 110 (only one of which is shown) adjacent the opposed sides of that section. Unlike the side frame members 16 and 18 employed in the first embodiment of this invention, the side frame members 110 do not taper from front to the rear edges thereof. Rather, except for relieved regions adjacent the lower front and rear edges, the side frame members 110 are of a uniform height; preferably $5\frac{1}{2}$ inches.

Referring specifically to FIG. 8, the rear edge of each of the side frame members 110 is tapered or relieved at 114, to provide clearance for the periphery 68 of the wheel or roller 66. A plurality of transversely extending, spaced-apart slats 116 provide the upper supporting surface of the forward section 100, and are secured to upper surfaces 113 of the side frame members 110 by nails, screws, or other suitable fastening means.

Still referring to FIG. 8, the rearward section 102 includes a pair of identical frame members 120 (only one of which is shown) designed to fit within transversely spaced-apart, identical side frame members 130 (only one of which is shown) of the intermediate section 104. Each of the side frame members 120 is similar in construction to the side frame members 110 described above, and like the side frame members 110, are formed from stock which preferably is $1\frac{1}{4}$–$1\frac{1}{2}$ thick.

Each of the side frame members 120 includes a rear surface 122 which is disposed in a horizontal plane, to lie flat on a horizontal supporting surface (e.g., the floor), when the frame construction 10A is folded into its chair or couch orientation as is illustrated in FIG. 8. Each of the side frame members 120 includes an outer surface 124 to which a plurality of transversely extending, spaced-apart slats 126 are secured by nails, screws, or other suitable fastening means. Each side frame member 120 also includes an inner edge 127 which is oriented to engage the ground or other supporting surface when the frame construction 10A is in its opened, bed orientation as is shown in FIGS. 11 and 12. In the preferred embodiment the inner edge 127 is tapered or relieved at 128, adjacent forward edge 129, to permit the desired range of movement of the rearward section 120 into its different positions.

Referring to FIG. 8, each of the side frame members 130 (only one of which is shown) of intermediate section 104 includes a bottom edge or surface 132 supportable on the ground or other supporting surface when the frame 10A in its bed orientation, as is shown in FIGS. 11 and 12. A plurality of transversely extending, spaced-apart slats 134 are supported and secured to top surfaces 136 of the side frame members 130 by suitable fastening means, such as nails or screws. In the preferred embodiment of this invention the side frame members 130, are formed from the same stock as side frame members 120 and 110.

Still referring to FIG. 8, it should be noted that each of the side frame members 130 of the intermediate section 104 includes a rear edge 138, and the bottom edge or surface 132 is inclined or tapered in an end region adjacent rear edge 138, so as to be disposed in a general vertical orientation when the frame 10A is folded into its couch or chair orientation, as can be seen best in FIG. 8. In this orientation the outer surfaces of the slats 126, which are secured to the side frame members 120 of rearward section 102, lie in a general vertical plane, to provide a very neat orientation for the couch or chair and to permit the couch or chair to be located closely adjacent a vertical supporting wall, if desired.

In a preferred form of this invention the seating surface provided by the transversely extending, spaced-apart slats 116 of section 100 has a length of approximately 25 inches; the backrest or intermediate section 104 defined by the transversely extending spaced-apart slats 134 has a length of approximately 20 inches, and the distance bound by the upper and lower transversely extending slats 126 of the rearward section 102 has a vertical dimension of approximately 25 inches.

Referring to FIGS. 8–12, the rearward section 102 is connected to the intermediate section 104 by a conventional pivot arrangement, including conventional pivot pins 140 retained within openings provided adjacent the rear edges 138 of each of the side frame members 130, and rotatably received within aligned openings (not shown) in adjacent side frame members 120 of the rear section 102.

Ends of the side frame members 110 of the forward section 100 are pivotally interconnected to adjacent, overlapping side frame members 130 of the intermediate section 104 by a pair of hinge and stop mechanisms 50A, which are very similar in operation to the hinge and stop mechanism 50 employed in connection with the first embodiment of this invention. Specifically, each of the hinge and stop mechanisms 50A includes an elongate slot 54A and a stop plate 62A associated with each side frame member 110, similar to the slot and stop plate included in each of the side frame members 16 and 18 of the first embodiment of this invention, for cooperating with a hinge pin 56A and stop pin 58A extending transversely from each of the side frame members 130, in a manner similar to the way the hinge pin 56 and stop pin 58 extend from the side frame member 32 and 34 of the first embodiment of this invention (e.g., see FIG. 12). Due to geometric differences between frames 10 and 10A, the angle between the stop plate 62 and top surface 28 of the side frame members 16 and 18 (i.e., approximately 107 degrees) is different from the angle between stop plate 62A and the top surface 113 of side frame members 110 (i.e., approximately 63.0 degrees).

Referring specifically to FIGS. 9–12, the manner of converting the tri-fold frame 10A from the seating piece orientation illustrated in FIG. 8 to the bed frame shown in FIG. 12 will now be described. It should be understood at the outset that this conversion can be accomplished completely from the front of the seating piece, preferably by a person gripping section 100 adjacent forward edge 106 thereof. First, the user merely pulls the front of forward section 100 in an outward direction, as indicated by arrow head 144 of the double-headed arrow 146. Due to the fact that the forward section 100 and intermediate section 104 are locked in the relative position occupied in the seating piece orientation shown in FIG. 8, as a result of the interconnection of elements by the hinge and stop mechanism 50A, the outward motion of the forward section 100 forces the front of the forward section in an upward direction, as is shown in FIG. 9. This causes the periphery 68 of the wheels or rollers 66 to engage the floor or other supporting surface. At this point the frame is touching the floor at two places; namely, along a line provided by the periphery 68 of each wheel 66, and along a line provided by the leading edge 148 (only one of which is shown) of the rear surface 122 of each of the side frame members 120. Applicant has discovered that, in the orientation achieved in FIG. 9, the leading edge 148 does not move from the position it occupied in the seating piece configuration shown in FIG. 8. Moreover, the engagement of leading edge 148 with the supporting surface is a relatively high friction engagement, as compared to the engagement provided between the supporting surface and the rotatable wheels or rollers 66. Thus, in this orientation, continuous movement in the direction of arrowhead 144 initially causes the sections 100, 102 and 104 to open up and/or extend very easily, and most importantly, the downward descent of the hinged rearward section 102 and intermediate section 104 is positively controlled by the rotation of the forward or seat section 100, in the direction of the arrow 150 illustrated in FIG. 10. This controlled movement is achieved because the forward section 100 remains locked against relative movement to the intermediate section 104, thereby providing for the controlled descent of both the intermediate section 104 and the rearward section 102 hinged thereto.

At some point in the opening process, the bottom tapered edge 99 of each side frame member 130 contacts the floor or other supporting surface (see FIG. 10). At this point, the edges 99 support more than two-thirds of the combined weight of the frame and cushion, and the reactionary force is primarily vertical (i.e., very stable). However, the major component of the approximate one-third of the total weight supported by the leading edge 148 is horizontal, and at some point exceeds the frictional engagement force at said edge. At this point continued pivotal movement of section 100 in the direction of arrow 150 causes the rearward section 102 to slide along the leading edge 148, in the direction indicated by arrow 152 in FIG. 10. However, this latter movement is controlled by the rotational movement directly applied to the forward section 100, to thereby positively control the descent of the hinged sections 102 and 104.

Referring to FIG. 11, when the rearward section 102 and intermediate section 104 initially reach a substantial horizontal orientation, wherein their bottom surfaces 127 and 132 engage the floor, the forward section 102 will be in a position approximately 18 degrees to the left of vertical, as viewed in FIG. 11. Thereafter, further clockwise rotational movement of the forward section 102 in the direction of arrow 154 positions the outer surfaces of slat 116 of the forward section 100 into a substantial vertical orientation, with the stop plate 62A being moved out of underlying relationship with the stop pin 58A in the same manner as described earlier in connection with the first embodiment of this invention. Thereafter, the forward section 100 is lifted upwardly in a general vertical direction to move the stop plate 62A above the stop pin 58A. In this latter position the forward section 102 can be rotated in a counterclockwise direction, as viewed in FIG. 11, to move said forward section into a generally horizontal position, as is illustrated in FIG. 12, to thereby complete the reorientation of the seating piece in FIG. 8 to the bed frame in FIG. 12.

It should be understood that the bed frame illustrated in FIG. 12 can be reconverted into the seating piece of FIG. 8 from the forward edge of seating section 100, by reversing the above-enumerated steps employed to convert the seating piece to a bed frame.

If desired, and as is known in the art, additional pivotal supporting members can be included on the tri-fold frame construction 10*a* to permit its conversion into a seating piece in which the rearward section 102 is inclined upwardly and rearwardly to form a backrest, and in which the forward and intermediate sections 100 and 104, respectively, are positioned at a angle relative to each other to provide a supporting surface for the lower torso. Specifically, in this construction additional supporting members are pivotally connected to side frame members 20 of the rearward section 102, adjacent the rear surface 122 thereof, and at the pivotal connection between the forward section 100 and intermediate section 104, respectively. Each of these additional frame members can be in the form of transversely spaced-apart linear struts, each pivotally secured adjacent a side frame member. Thus, in an extended condition, the pairs of struts form legs to support the tri-fold construction in its seating piece orientation. Alternatively, the frame members can be in the shape of U-shaped supports, each including linear struts of the type described above, but joined together by a connecting horizontal base member. In use these U-shaped members are positioned so that the horizontal connecting base members engage the ground or other supporting surface.

When the frame members of the tri-fold construction 10*a* are pivoted into a position to provide their supporting function, the rear frame section 102 is pivoted into an upwardly and rearwardly inclined orientation to provide a comfortable backrest section. The forward and intermediate sections are pivoted into an orientation wherein the pivotal connection between them is raised upwardly. In this orientation the intermediate section 104 basically underlies the buttocks and upper leg region of a user of the seating piece, whereas the forward section 100 basically underlies the lower leg region of the user.

The above described arrangement of providing additional frame members in conjunction with a tri-fold unit is well known in the prior art, and is discussed herein only for purposes of completeness.

Without further elaboration the foregoing will so fully illustrate my invention that others may, by applying current or future knowledge, adopt the same for use under various conditions of service.

I claim:

1. A furniture frame convertible from a first orientation to at least a second orientation, said frame including two sections pivotally connected together and being movable relative to each other to permit the frame to be moved between the first and second orientations, one of said two sections including a frame member having one end closely adjacent to and overlapping an end of a frame member of the other of said two sections, and hinge and stop means for permitting relative rotational movement between said two sections to permit conversion of the frame between the first and second orientations and for locking said two sections against relative rotational movement in one of said first and second orientations, said hinge and stop means including an elongate slot in one of said overlapping ends, a hinge pin connected to the other of said overlapping ends and being rotatably retained with said slot to provide a pivotal connection between the first and second sections, cooperating stop means on said one of said overlapping ends and on said other of said overlapping ends for engaging each other when said hinge pin is in a first location within said elongate slot to maintain the frame in said first orientation, and for disengaging from each other when the hinge pin is in a second position within said elongate slot to permit the frame to assume said second orientation, said cooperation stop means including a stop plate on said one of said overlapping ends and a stop pin on said other of said overlapping ends, said stop pin and stop plate being located to engage each other when said hinge pin is in a first location within said elongate slot to maintain the frame in said first orientation, and to be disengaged from each other when said hinge pin is in a second position within said elongate slot to permit the frame to assume said second orientation.

2. The furniture frame of claim 1, wherein said two sections provide a seat section and backrest section, respectively, of a seating piece when the frame is in said first orientation, and wherein said two sections provide a bed frame when the frame is in said second orientation.

3. The furniture frame of claim 2, wherein each of said two sections has transversely spaced apart frame members, each of the transversely spaced apart frame members of said one of said two sections having one end closely adjacent to and overlapping an end of a frame member of the other of said two sections to provide multiple pairs of frame members having overlapping ends, the overlapping ends of at least two pairs of frame members each having said hinge and stop means.

4. The furniture frame of claim 3, further including roller means in the form of two rollers, each roller being rotatably secured to a different frame member of transversely spaced-apart frame members of one of said two sections.

5. The furniture frame of claim 2, including a third section pivotally secured to the section providing the backrest section at a location remote from the pivotal connection between the seat section and backrest section.

6. The furniture frame of claim 5, wherein said third section assumes a first position when the first and second section are in said first orientation and a second position when the first and second sections are in said second orientation, said first, second and third sections having upper surfaces substantially in the same plane when said first and second sections are in said second orientation and said third section is in said second position.

7. The furniture frame of claim 5, further including roller means rotatably secured to one of said two sections adjacent the overlapping ends of the frame members.

8. The furniture frame of claim 1, wherein each of said two sections has transversely spaced apart frame members, each of the transversely spaced apart frame members of said one of said two sections having one end closely adjacent to and overlapping an end of a frame member of the other of said two sections to provide multiple pairs of frame members having overlapping ends, the overlapping ends of at least two pairs of frame members each having said hinge and stop means.

9. The furniture frame of claim 8, further including roller means in the form of two rollers, each roller being rotatably secured to a different frame member of transversely spaced-apart frame members of one of said two sections.

10. The furniture frame of claim 1, including a third section pivotally secured to one of said two sections, said third section being movable relative to said two sections.

11. The furniture frame of claim 10, further including roller means rotatably secured to one of said two sections adjacent the overlapping ends of the frame members.

12. The furniture frame of claim 1, further including roller means rotatably secured to one of said two sections adjacent the overlapping ends of the frame members.

13. The furniture frame of claim 12, wherein one of said two sections provides a seat section when the frame is in said first orientation, said roller means being rotatably secured to a frame member of said one of said two sections.

14. The furniture frame of claim 12, wherein said roller means is positioned for engaging a frame-supporting surface as said frame is moved between said first and second orientations.

15. A furniture frame convertible from a first orientation to at least a second orientation, said frame including two sections pivotally connected together and being movable relative to each other to permit the frame to be moved between the first and second orientations, one of said two sections providing a seat section and the other of said two sections providing a backrest section, respectively, of a seating piece when the frame is in said first orientation, and wherein said two sections provide a bed frame when the frame is in said second orientation, said one of said two sections including a frame member having one end closely adjacent to and overlapping an end of a frame member of said other of said two sections, said seat section having a forward edge and a rear edge and said backrest section having an upper edge and a lower edge when the frame is in said first orientation, said overlapping ends of the frame members of said seat and backrest sections being adjacent the rear edge of the seat section and the lower edge of the backrest section, and hinge and stop means for permitting relative rotational movement between said two sections to permit conversion of the frame between the first, seating piece orientation and the second, bed frame orientation and for locking said two sections against relative rotational movement when said two sections are in said first orientation, said hinge and stop means including an elongate slot in a frame member of the seat section in a region of said frame member overlapping a frame member of the backrest section, said elongate slot having a long dimension aligned in a direction from the forward edge to the rear edge of said seat section, a hinge pin connected to a frame member of the backrest section and being rotatably retained within said elongate slot to provide a pivotal connection between the first and second sections, cooperating stop means on said overlapping ends of the seat section and backrest section, respectively, for engaging each other when said hinge pin is in a first location within said elongate slot and said two sections are in the orientation of a seating piece, said cooperating stop means, when engaging each other, precluding movement of said hinge pin within said slot to a second position in which said frame can be moved into its second, bed frame orientation, said seat section and said backrest section being pivotally movable relative to each other about said hinge pin for disengaging the cooperating stop means and thereby permitting movement of the hinge pin within said slot to said second position in which the frame can be positioned into the second, bed frame orientation.

16. The furniture frame of claim 15, wherein pivotal movement of said seat section relative to said backrest section about said hinge pin for disengaging the cooperating stop means is carried out by first manually rotating the seat section upwardly to thereby rotate the backrest section downwardly into a generally horizontal position without relative pivotal movement between said seat section and said backrest section, and, after further downward movement of the backrest section is precluded by the engagement of the backrest section with a supporting surface when said backrest section assumes said generally horizontal position, pivoting the seat section relative to the backrest section for disengaging the cooperating stop means, at which point said seat section can be moved outwardly along the direction of elongation of said elongate slot to thereby position the cooperating stop means in a location for permitting downward pivotal movement of the seat section relative to the stationary backrest section in a direction opposed to said upward rotational movement of said seat section, to thereby position said seat section and said backrest section into the second, bed frame orientation.

17. A furniture frame convertible from a first orientation to at least a second orientation, said frame including two sections pivotally connected together and being movable relative to each other to permit the frame to be moved between the first and second orientations, one of said two sections including a frame member having one end closely adjacent to and overlapping an end of a frame member of the other of said two sections, and hinge and stop means for permitting relative rotational movement between said two sections to permit conversion of the frame between the first and second orientations and for locking said two sections against relative rotational movement in said first orientation, said hinge and stop means including an elongate slot in one of said overlapping ends, a hinge pin connected to the other of said overlapping ends and being rotatably retained within said slot to provide a pivotal connection between said two sections, cooperating stop means on said one of said overlapping ends and on said other of said overlapping ends for engaging each other when said hinge pin is in a first location within said elongate slot to maintain the frame in said first orientation, and for disengaging from each other when the hinge pin is in a second position within said elongate slot to permit the frame to assume said second orientation, said cooperating stop means including surfaces for engaging each other when said hinge pin is in a first location within said elongate slot to maintain the frame in said first orientation and for precluding movement of said hinge pin into said second position within said elongate slot at which the frame may be moved into said second orientation, said two sections being pivotally movable relative to each other about said hinge pin for disengaging the surfaces of the cooperating stop means to permit movement of said hinge pin into said second position within said elongate slot.

18. The furniture frame of claim 17, wherein pivotal movement of said two sections about said hinge pin for disengaging the cooperating stop means is carried out by first manually rotating said one of said two sections upwardly to thereby rotate the other of said two sections downwardly into a generally horizontal position without relative pivotal movement between said two sections, and, after further downward movement of the other of said two sections is precluded by the engagement of said other of said two sections with a supporting surface when said other of said two sections assumes said generally horizontal position, pivoting said two sections relative to each other for disengaging the cooperating stop means, at which point said one of said two sections can be moved in the direction of elongation of said elongate slot to thereby position the cooperating stop means in a location for permitting downward pivotal movement of said one of said two sections relative to the other of said two sections in a direction opposed to said upward rotational movement, to thereby position said two sections into the second, bed frame orientation.

19. The furniture frame of claim 17, wherein said two sections provide a seat section and backrest section, respectively, of a seating piece when the frame is in said first orientation, and wherein said two sections provide a bed frame when the frame is in said second orientation.

20. The furniture frame of claim 17, wherein each of said two sections has transversely spaced apart frame members, each of the transversely spaced apart frame members of said one of said two sections having one end closely adjacent to and overlapping an end of a frame member of the other of said two sections to provide multiple pairs of frame members having overlapping ends, the overlapping ends of at least two pairs of frame members each having said hinge and stop means.

21. The furniture frame of claim 20, further including roller means in the form of two rollers, each roller being rotatably secured to a different frame member of transversely spaced-apart frame members of one of said two sections.

22. The furniture frame of claim 17, including a third section pivotally secured to one of said two sections, said third section being movable relative to said two sections.

23. The furniture frame of claim 22, further including roller means rotatably secured to one of said two sections adjacent the overlapping ends of the frame members.

* * * * *